United States Patent [19]

Potter

[11] 4,291,539

[45] Sep. 29, 1981

[54] POWER GENERATION SYSTEM

[75] Inventor: Owen E. Potter, Camberwell, Australia

[73] Assignee: Monash University, Victoria, Australia

[21] Appl. No.: 974,244

[22] Filed: Dec. 29, 1978

[30] Foreign Application Priority Data

Feb. 10, 1978 [AU] Australia ..... PD3342

[51] Int. Cl.[3] ..... F01K 21/00

[52] U.S. Cl. ..... 60/670; 34/12; 34/86; 110/221; 110/229; 60/645

[58] Field of Search ..... 34/12, 86; 110/221, 110/229, 101 R; 60/643, 645, 670

[56] References Cited

U.S. PATENT DOCUMENTS

| | | | |
|---|---|---|---|
| 1,530,439 | 3/1925 | Testrup et al. | 34/86 |
| 3,131,035 | 4/1964 | Erickson | 34/86 X |
| 3,181,488 | 5/1965 | Roe et al. | 110/101 R |
| 3,186,175 | 6/1965 | Strohmeyer, Jr. | 60/678 |
| 3,192,068 | 6/1965 | Brandt | 34/86 X |
| 3,309,780 | 3/1967 | Goins | 34/86 X |
| 3,798,785 | 3/1974 | Chamouton | 34/86 X |

*Primary Examiner*—Allen M. Ostrager

*Attorney, Agent, or Firm*—Larson and Taylor

[57] ABSTRACT

The invention resides in an electrical power generation system comprising means for burning solid carbonaceous fuel, such as brown coal, to generate heat energy which is used to convert water to steam, turbine means driven by the said steam for producing electrical energy, and solid carbonaceous fuel drying means, wherein moist fuel is indirectly heated by steam in the drying means in the absence of introduced air or other gases, whereby water vapor substantially free from air or other gases is driven off from the fuel for further use and the dried fuel is passed to the burning means. Preferably, the solid carbonaceous fuel drying means is in the form of a fluidized bed in which the fluidizing medium is water vapor. Further, the fluidized bed may be indirectly heated by saturated steam which transfers heat to the solid carbonaceous fuel and becomes condensed.

11 Claims, 2 Drawing Figures

Figure 1:
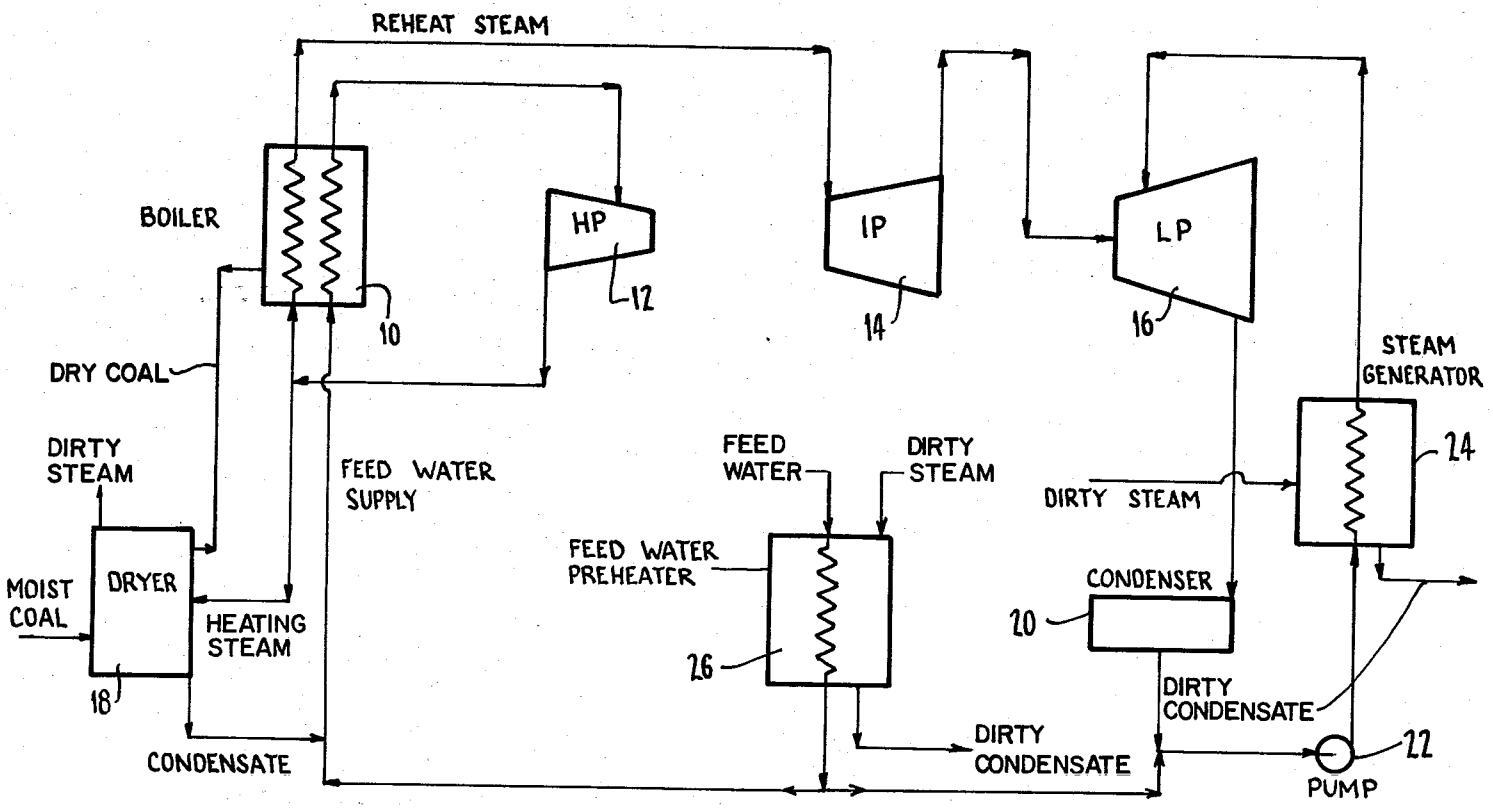

NOTE: FOR SIMPLICITY, CARRIER STEAM IS NOT SHOWN IN THIS FIGURE.

NOTE: FOR SIMPLICITY, CARRIER STEAM IS NOT SHOWN IN THIS FIGURE.

STEAM
CONDENSATE

REHEAT STEAM
HP TURBINE
IP TURBINE
BOILER
70
72
74
FEED WATER HEATER
86
HEATING STEAM
CARRIER STEAM
LP TURBINE
80
STEAM GENERATOR
CONDENSER
82
78
76
DIRTY CONDENSATE
BLOW-DOWN
FEED WATER HEATER
FRESH CLEAN FEED WATER 68° F
DIRTY CONDENSATE
84

POWER GENERATION SYSTEM

CROSS-REFERENCE TO RELATED APPLICATIONS

Co-filed Application No. 974,245 filed Dec. 29, 1978 based on Australian No. PD 3341 filed Feb. 10, 1978 and co-filed Application No. 974,246 filed Dec. 29, 1978 based on Australian Application No. PD 3344 filed Feb. 10, 1978, the disclosures of which are incorporated herein by reference.

The present invention relates to an electrical power generation system.

Solid carbonaceous materials are an important fuel for generation of electrical power. Typically, the fuel is burnt in a boiler producing heat energy used to produce steam. The steam is fed to a turbine system where it is used to produce the electrical power.

Frequently the raw coal has a high moisture content which adversely effects the power generation. This is particularly the case with brown coal which often contains two pounds water per pound of dry coal and therefore presents special problems in combustion.

Transportation and handling costs of raw brown coal, on an available energy basis, are high because of the high moisture content. Normal commercial practice is to site brown coal consuming power stations on or adjacent to the coal deposits. The coal is then burned in its raw state thereby creating a number of major disadvantages. About 20% of the gross caloric value of the brown coal is used to evaporate the water contained in the coal. The energy is lost as the vapour passes through the system and out of the stack uncondensed. There is a 25% increase in flue gas volume and therefore the size and cost of most of the units through which the flue gas passes are correspondingly increased. Further, the large quantities of water vapour present in the combustion products of the brown coal significantly reduce flame temperature. This leads to a reduction in radiant heat transfer so that radiant tube area has to be increased twofold. Therefore, a boiler of much greater size and cost is required to house the additional tubes. Difficulty in fuel ignition and maintenance of fuel stability are two other unsolved problems arising from the use of raw brown coal in boilers.

It is possible to increase the efficiency of a boiler substantially by burning dry coal instead of raw coal. It is known to dry brown coal prior to combustion using air which has been heated by steam or hot gases and drawing or blowing the heated air over or through the brown coal in particulate form. However, this method of drying offers no advantages compared to burning raw coal since the steam driven off is admixed with air. The air/steam mixture is simply vented to the atmosphere and its energy content lost since it is not economical to attempt to recover or use the energy.

The present invention relates to an electrical power generation system in which dried solid carbonaceous fuel is used to provide the heat energy for the production of steam.

In accordance with the present invention there is provided an electrical power generation system comprising means for burning solid carbonaceous fuel to generate heat energy which is used to convert water to steam, turbine means driven by the said steam for producing electrical energy, and solid carbonaceous fuel drying means, wherein moist fuel is indirectly heated in the drying means by steam in the absence of introduced air or other gases, whereby water vapour substantially free from air or other gases is driven off from the fuel and the dried fuel is passed to the burning means.

In a system of the present invention the steam after expansion through a relatively high pressure turbine may be used for drying the fuel such as brown coal and then used for generating further electricity in the low pressure turbine. Thus, the energy content of this steam is utilized in at least three stages.

Further, the fuel is indirectly heated to remove moisture therefrom and no air or other gas is introduced into the drying means during the drying step. A small amount of gas may be released from the coal as it dries but the water vapour driven off from the fuel is not admixed with substantial quantities of other gases. Therefore, it is feasible to use the energy content of the water vapour for further purposes.

The drying means can take any suitable form, for example, it could be a scraped surface exchanger. However, it is preferably a fluidized bed apparatus in which the fuel in particulate or lump form is heated indirectly by the steam from the high pressure turbine and the fluidizing medium is steam or water vapour. Such an apparatus is described in detail in the complete specification of our co-filed Patent Application No. 974,245.

In a power generation system, in accordance with the present invention steam obtained from the relatively high pressure turbine may be fed under pressure, prior to reheat, to the drying means so as to transfer heat to the fuel in the drying means. The steam may be exhaust steam from a high pressure turbine. Alternatively, the steam may be drawn off at some point in an intermediate pressure turbine. Preferably the steam is desuperheated by condensate injection prior to being fed to the drying means. Typically, the steam is fed to the drying means at a pressure from atmospheric to 3200 p.s.i.a. A higher pressure leads to a larger temperature difference between drying apparatus and the fuel. The temperature may range as high as 270°-300° C. for brown coal, at which temperature the brown coal gives off volatiles, and down to a temperature determined by the need for drying to continue.

The indirect heating effect causes steam or water vapour to be driven off from the moist fuel at a relatively low pressure less than 10 p.s.i.g. such as 5 p.s.i.g. Providing the residence time of the fuel in the drying means is sufficient the bulk of the water contained therein can be driven off in this way. Where the coal contains initially 66% of water by weight removal of 90% of the water reduces the water content to 16%.

The steam produced from the dryer is of low grade but its latent heat is available for use at various points in the power generation system. For example, a boiler-feed preheater, which in conventional systems uses turbine bleed steam, may be replaced by one using the steam from the dryer. Also, some or all of the dryer steam may be fed to a steam generator where clean steam is produced which may be then fed into a low pressure turbine to produce further electrical energy. Alternatively, the dryer steam could be used for air pre-heating.

A steam generator is a device in which dirty vapour from the dryer condenses in tubes or coils and indirectly thereby heats water to produce steam at a lower pressure. If the dirty vapour is produced at pressures at or slightly about atmospheric pressure then the (clean)

steam side may be at a pressure somewhat less than atmospheric pressure.

The power generator of the present invention has a reduced fuel requirement for generation of each unit of power and enables boilers having considerably reduced size to be used.

The dryer steam condensed in the steam generators may be filtered to remove coal fines leaving a clean water product which will be contaminated only by coal particles which escape the filter. This water product is suitable for further applications such as addition to local stream flow, for domestic use, for municipal water supply or as boiler feed water. To remove any entrained particles in the water a filter may be used.

In the present invention the fuel such as raw brown coal will be typically size reduced prior to drying, usually to particulate form of 2 cm or less. Preferably, the brown coal is size reduced to from 40 μm to 1000 μm. Brown coal reduced to 500 μm or less will inevitably contain some fines. The presence of fines may improve the fluidity of the fluidized bed but offer a problem in that the fines can escape necessitating capture such as on cyclones. Also, the distribution of particle sizes could lead to some segregation in which large particles settle to the bottom of the bed before being sufficiently heated. Therefore, it is envisaged that the size reduction may need to be, with some coals, such as to reduce the size of the largest particles to 250–300 μm. Preferably, no more than 20% of the raw coal feed is in the form of particles having a size below 40 μm.

Also, as described in detail in the complete specification of our co-filed Patent Application No. 974,245 the fuel may be in lump form typically having a size range from 0.3 cm to 10 cm such as 5 cm. In this case the fluidized bed contains another, particulate fluidizing material such as silica sand and the fuel is introduced in lump form.

The dirty vapour produced from the dryer in accordance with the present invention also lends itself to mechanical vapour recompression. The dirty vapour is preferably first passed through a cyclone system to remove solids which are preferably returned to the drying means. The vapour from the cyclone is then passed to a steam-generator which produces clean steam by heating the condensate from the low pressure turbine condenser. The clean steam so produced may or may not be superheated but in any event is preferably compressed in an appropriate apparatus such as a centrifugal compressor to a sufficiently high pressure to become saturated for an adequate heat transfer rate in the drying means such as between 20 and 2000 p.s.i.a., preferably between 50 and 500 psia. The compressed and preferably de-superheated steam is passed through the dryer tubes wherein it is condensed and effects further drying of raw coal. In this embodiment of the present invention, no steam is withdrawn from the turbines but a turbo-compressor may be driven by the turbines in order to compress the clean steam from the steam generator.

Further, where the drying means is a fluidized bed apparatus, carrier steam may be drawn from the compressor at a low pressure such as less than 10 p.s.i.a., for example 5 p.s.i.a., above the fluidized bed pressure which will be preferably close to atmospheric, and fed to a distributor at the bottom of the dryer.

The dirty vapour may also be used to indirectly heat a conventional fluidized bed which is fluidized by air or other gas. This is described in detail in the complete specification of our co-filed Patent Application No. 974,246.

Figure 2:
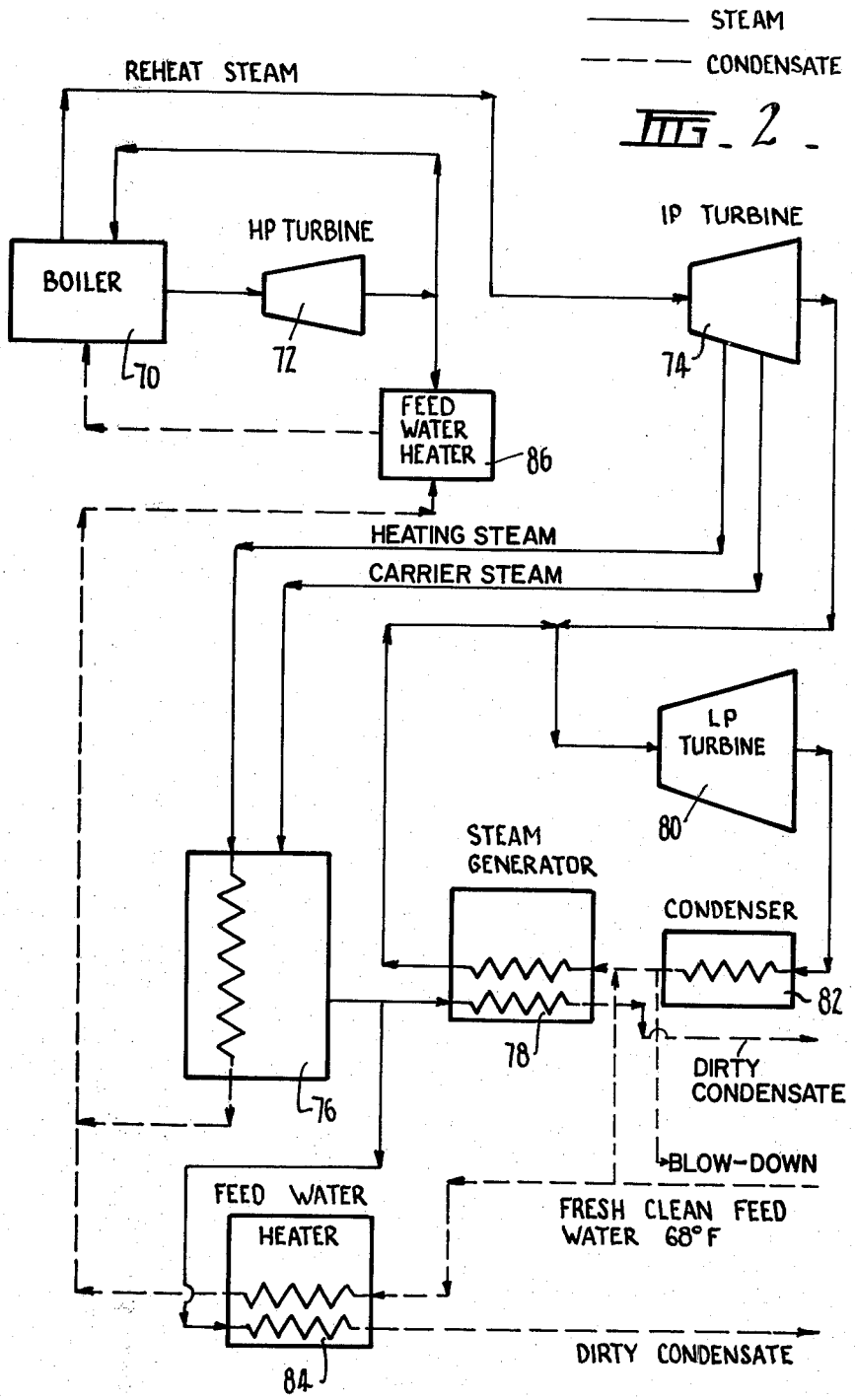

The present invention will now be described with reference to the accompanying drawings, in which:

FIG. 1 is a schematic flow diagram of a power generation system in accordance with the present invention; and FIG. 2 is a schematic flow diagram of an alternative power generation system in accordance with the present invention.

In FIG. 1 there is shown an electric power generation system comprising a boiler 10, a high pressure turbine 12, an intermediate pressure turbine 14 and a low pressure turbine 16. The system further comprises a dryer 18, a condenser 20, a pump 22, a steam generator 24 and a feed water preheater 26.

The boiler 10 comprises inlet means for dry brown coal and means for burning the coal to produce heat energy to evaporate water supplied by a feed water supply. The steam produced by evaporation of the feed water supply is fed to the high pressure turbine 12 wherein electrical energy is produced. The exhaust steam from the high pressure turbine 12, which is not used for some purpose such as feed water heating, is returned to the superheat section of the boiler 10 for reheat. Conveniently, a portion of the latter steam is, prior to reheat, fed to the dryer 18 wherein it is used to indirectly heat raw moist coal in accordance with the present invention. Where it is desired to dry coal additional to that used for combustion, all the steam may be diverted to the dryer and subsequently returned, indirectly, to the turbine.

In an alternative embodiment of the present invention, steam may be withdrawn for drying purposes not from the exhaust of the high pressure turbine 12 but from some point in the intermediate pressure turbine 14. This enables a more efficient cycle to be obtained but at higher capital cost of the dryer 18.

The steam used to indirectly heat the coal loses some of its energy and becomes a condensate which is recycled back into the feed water supply or the boiler 10.

The reheat steam from the boiler 10 is fed to the intermediate pressure turbine 14 in which it is used to generate electrical energy.

The exhaust steam from the low pressure turbine 16 is fed to a condenser 20 wherein it is condensed, and then pumped via the pump 22 through a steam generator 24. Dirty steam produced from the drying means 18 in accordance with the present invention is fed at least partially to the steam generator 24 wherein the condensed steam from the low pressure turbine 16 is reconverted to steam and fed back to the low pressure turbine to generate further electrical power. The steam generator 24 has a high heat transfer coefficient and much of the latent energy in the dirty steam is transferred to the condensed vapour from condenser 20. The dirty steam is itself condensed to water which is relatively clean and suitable for further use as discussed above.

Some of the dirty steam may be fed to the feed water preheater 26 wherein it is used to partially heat the feed water prior to entry into the boiler 10. Again, the condensate of dirty steam is suitable for further use.

In the flow diagram of FIG. 2 steam is first generated in a boiler 70 by burning of coal. The steam is passed through a high pressure turbine 72 in which electrical energy is produced and the steam loses some of its energy. The steam issuing from the high pressure turbine 72 is returned to the boiler 70 for reheat. The reheat steam from the boiler 70 is used to drive the intermediate pressure turbine 74.

The steam from a point in the intermediate pressure turbine 74 such as half-way along the turbine, is used as a drying medium in a fluidized bed dryer 76 in accordance with the present invention. This steam serves to effect heat transfer to the coal in the dryer 76 by passage through tubes therein. Carrier steam, from a later stage in the intermediate pressure turbine, passes through a distributor in the dryer.

The dirty steam from the dryer is fed to a steam generator 78 in which low pressure clean steam is produced. The clean steam may be passed to a low pressure turbine 80 for further power generation from whence it passes through a condensor 82 and is then recycled to the steam generator 78 for reconversion to clean steam.

Some or all of the dirty steam may be passed to a feed water heater 84 to generate heated fresh clean feed water. The feed water from the feed water heater 84 can be passed to a further feed water heater 86 to generate heated feed water for the boiler 70. The dirty condensate from the steam generator 78 may be cleaned such as in a cyclone and/or by means of filters to produce clean water.

Further, the condensate from the dryer tubes can be passed to the feed water heater 86 for reheating prior to being fed to the boiler 70.

The dried coal from the dryer 76 is fed to the boiler 70 where considerable benefits are obtained as discussed above.

From the power generation system of FIGS. 1 and 2 it can be seen that the dirty steam from the dryer contains energy in a form which is available for further use whilst at the same time the moisture content of the coal is reduced thereby enabling the coal to be burnt more efficiently in a smaller boiler than otherwise would be the case.

Also, in the practice of the present invention steam can be withdrawn at any appropriate pressure, used in the dryer, and returned at any appropriate lower pressure.

Further, carrier steam may be drawn from dirty vapour after cleaning in cyclones and fed back to the fluidized bed by means of a blower possibly being heated on the way by higher pressure steam or other heat source.

Modifications and variations such as would be apparent to a skilled addressee in the art of electrical power generation are deemed within the scope of the present invention. For example, the power generation system of the present invention can include multiple effect drying in place of the single effect drying shown in the drawings.

Multiple effect drying is described in detail in the complete specification of our co-filed Patent Application No. 974,246 entitled "Fluidized Bed Drying".

I claim:

1. An electrical power generation system comprising means for burning solid carbonaceous fuel to generate heat energy which is used to convert water to steam, at least one turbine means driven by the said steam for producing electrical energy, and solid carbonaceous fuel drying means, in which moist fuel is indirectly heated by steam in the drying means and dried fuel is passed to the burning means; characterized in the moist fuel is heated in the drying means in the absence of introduced air or other gases, whereby water vapour substantially free from air or other gases is driven off from the fuel for further use.

2. An electrical power generation system as claimed in claim 1, in which the solid carbonaceous fuel drying means is in the form of a fluidized bed in which the fluidizing medium is water vapour.

3. An electrical power generation system as claimed in claim 2, in which the fluidized bed is indirectly heated by saturated steam which transfers heat to the solid carbonaceous fuel and becomes condensed.

4. An electrical power generation system as claimed in claim 1 in which the indirect heating steam is obtained from said high pressure turbine.

5. An electrical power generation system as claimed in claim 4, in which the indirect heating steam is exhaust steam from said high pressure turbine.

6. An electrical power generation system as claimed in claim 4, in which the indirect heating steam is drawn off from a point in an intermediate pressure turbine.

7. An electrical power generation system as claimed in claim 1, in which water vapour driven off from the fuel is used for preheating boiler feed water or pre-heating air.

8. An electrical power generation system as claimed in claim 1, in which water vapour driven off from the fuel is fed to a steam generator where clean steam is produced which is then fed into said low pressure turbine to produce electrical energy.

9. An electrical power generation system as claimed in claim 2, in which the fluidized bed is indirectly heated by saturated steam which transfers heat to the solid carbonaceous fuel and becomes condensed and in which the indirect heating condensate is heated indirectly in a steam generator by water vapour driven off from the fuel to produce clean steam which is subsequently compressed and desuperheated to become saturated and then used for further indirect heating of moist fuel.

10. An electrical power generation system as claimed in claim 2, in which the fluidized bed is indirectly heated by saturated steam which transfers heat to the solid carbonaceous fuel and becomes condensed and in which the indirect heating condensate is heated indirectly in a steam generator by water vapour driven off from the fuel to produce clean steam which is subsequently compressed by a turbo compressor driven by said turbine means.

11. An electrical power generation system according to claim 1 wherein the turbine means comprises a high pressure turbine, an intermediate pressure turbine and a lower pressure turbine.

* * * * *